US008075426B1

(12) United States Patent
Griffin

(10) Patent No.: US 8,075,426 B1
(45) Date of Patent: Dec. 13, 2011

(54) POWER PIVOT

(76) Inventor: Tyrome Vontrece Griffin, Tampa, FL (US)

( * ) Notice: Subject to any disclaimer, the term of this patent is extended or adjusted under 35 U.S.C. 154(b) by 120 days.

(21) Appl. No.: 12/659,542

(22) Filed: Mar. 12, 2010

(51) Int. Cl.
*A63B 69/00* (2006.01)

(52) U.S. Cl. ..... 473/452; 473/271; 482/147; 482/79

(58) Field of Classification Search ..... 473/451–453, 473/217, 269, 270; 482/70, 71, 79, 146, 482/147; D6/455
See application file for complete search history.

(56) References Cited

U.S. PATENT DOCUMENTS

| | | | | |
|---|---|---|---|---|
| 2,189,613 | A * | 2/1940 | Paulsen | 473/270 |
| 3,372,930 | A * | 3/1968 | Sertich | 473/452 |
| 3,466,040 | A * | 9/1969 | Sertich | 473/452 |
| 3,575,412 | A * | 4/1971 | Arsenian et al. | 482/71 |
| 3,593,994 | A * | 7/1971 | Anbar | 482/147 |
| 4,560,165 | A * | 12/1985 | Witteman et al. | 473/269 |
| 4,629,181 | A * | 12/1986 | Krive | 482/71 |
| 5,037,094 | A * | 8/1991 | Johnson | 473/452 |
| 5,318,290 | A * | 6/1994 | Sawyer | 473/217 |
| 5,810,673 | A * | 9/1998 | Castleberry | 473/217 |
| 6,176,817 | B1 * | 1/2001 | Carey et al. | 482/146 |
| 6,723,004 | B1 * | 4/2004 | Florian | 473/270 |
| 6,749,529 | B1 * | 6/2004 | Sobolewski | 473/451 |
| 6,824,500 | B2 * | 11/2004 | Park et al. | 482/51 |
| 7,335,117 | B2 * | 2/2008 | Reason-Kerkhoff | 473/452 |
| 7,955,181 | B2 * | 6/2011 | Drollinger et al. | 473/272 |
| 2004/0038757 | A1 * | 2/2004 | Mahoney | 473/452 |
| 2006/0046864 | A1 * | 3/2006 | Pagano | 473/270 |
| 2008/0085788 | A1 * | 4/2008 | Rainer et al. | 473/452 |
| 2011/0092318 | A1 * | 4/2011 | Torch | 473/452 |

* cited by examiner

*Primary Examiner* — Mark Graham
(74) *Attorney, Agent, or Firm* — Hugh B. Thompson, II

(57) ABSTRACT

A baseball swing training apparatus comprised of upper and lower platform members that are rotatably secured to one another by means of a bearing plate assembly. The platform members have a generally rectangular body with at least one side of each platform member formed as an extending finger portion. The extending finger portion of the upper platform member receives thereon a spring loaded foot mechanism. The spring loaded foot mechanism is comprised of a continuous cylindrical member having upper and lower U-shaped ends, the upper and lower ends being orthogonal to one another and forming an L-shaped continuous cylindrical member. A coiled spring member is secured to the upper platform member and to the upper U-shaped end by a hook shaped element. The coiled spring member is secured to the upper platform member by an elongated rod, the ends of which are received within apertures defined by the coiled spring. The ends of the rod are in turn received within an eye portion of spaced apart eyebolts.

20 Claims, 6 Drawing Sheets

POWER PIVOT

FIELD OF THE INVENTION

This invention generally relates to a baseball swing training apparatus. More specifically, the invention pertains to an apparatus which assists a batter in the proper distribution of weight, leg spacing, and hip rotation during the act of swinging a baseball bat or similar device.

BACKGROUND OF THE INVENTION

1. The Field of the Invention

Devices that assist hitters of a baseball or softball have been in existence for quite some time. Essential to proper positioning of a batter's feet and hips during a swinging motion, is the pivoting motion of a batter's rear foot. When swinging a bat, it is a fundamental necessity that a batter pivot and push on the ball of the rear foot. This motion encourages the batter to distribute his or her weight properly during a swing through motion, giving the batter better balance, more power, and quicker hand speed. These elements serve to increase the probability of a batter hitting a ball.

It is very common for devices of this type to have upper and lower plate-like surfaces that rotate relative to one another. There is typically some sort of foot restraint, such as a strap or belt, which secures the user's back or rear foot relative to the upper plate surface. The lower plate may have a ground engaging or penetrating means that fixes the device on a preferably level support surface. Devices of this sort may also have a friction or non-slip support surface integral to the upper plate, which reduces the likelihood of the user's foot slipping when the device is in use. The upper and lower plates rotate relative to one another by means of ball bearings, a simple pivot pin, a screw, or other similar mechanisms that permit 360 degree rotation between the plates.

There have been attempts to ensure the proper balance on the back leg of the batter during the batting motion. Ideally, to ensure an optimum swing, these devices should force a user to raise his or her heel and transfer pressure to the ball of the foot, causing the hips of the user to rotate, thus promoting quicker hand speed and an increase of power at the plate. However, there is still a need for a device that can accomplish all of the aforementioned elements of an optimum swing.

2. Description of Related Art

An examination of the prior art of record discloses various types of foot trainers, pivot positioners, baseball swing training apparatuses, or even golf swing improvement devices. U.S. Pat. No. 5,318,290 to Sawyer (herein "Sawyer-290"), discloses a baseball swing training apparatus comprised of upper and lower members, 40 (platform member) and 20 (base member), respectively. There is a pivot unit 14 that allows for 360 degree rotation of the members relative to one another. There is also a foot supporting strap 62 that secures a user's foot to the upper member and an anchor unit 30 that secures the apparatus to a level support surface, i.e., the batter's box. Sawyer-290 attempts to immobilize the user's back foot save for the pivoting motion of the foot during a swing. Sawyer-290 fails to address a means for forcing a user to raise his or her heel during the swinging motion, thus transferring pressure to the ball of the user's foot causing the hips of the user to rotate, promoting quicker hand speed and increased power at the plate.

U.S. Pat. No. 5,810,673 to Castleberry (herein "Castleberry-673"), discloses a golf swing improvement device. Castleberry-673 is similar to the functioning of Sawyer-290 in that there are two plates rotatable relative to one another, the upper plate having a foot strap and non-slip surface for securing the user's foot in place. There is a surface engaging means 20 that secures the device to level support surface 30. There is no requirement that the device of Castleberry-673 urge a user's heel in an upward motion during the swinging motion that results in quicker hand speed and increased power at the plate.

U.S. Pat. No. 3,372,930 to Sertich (herein "Sertich-930"), discloses a foot trainer having an adjustable rotation and friction means. As with the aforementioned prior art of record, Sertich-930 comprises two plates rotatable with respect to one another and a foot securing strap. Sertich-930 does disclose a foot guide means 66, 66' that guides and positions the heel of the foot on the base member. However, this heel engaging element does not urge the heel upward.

U.S. Pat. No. 3,466,040 to Sertich (herein "Sertich-040"), discloses a pivot positioner for a baseball player's rear foot. Sertich-040 is similar to the basic functioning of the device of Sertich-930. There are two plates rotatable relative to one another and a foot securing means 230, 230'. There is a ground engaging means 260 and a pivot mechanism 150. Though Sertich-040 does refer to the importance of hitters pivoting and pushing on the ball of the rear foot when batting, there is no disclosure of a means for urging the heel of the foot upward during the swinging motion.

U.S. Pat. No. 4,629,181 to Krive (herein "Krive-181"), discloses a multi-directional movement leg exerciser used to simulate skiing. The structure of Krive-181 is very similar in structure to that of the instant invention. There are upper and lower plates 24, 22, secured to bearing plate assembly members 42, 40, respectively. There is a ball bearing assembly 44, 46 there between that permit 360 degree rotation between the upper and lower plates. Krive-181 also discloses foot engaging members 26, 28 and resilient elements 62, 64, located beneath the foot engaging members, the upper end 66 of which is beveled downwardly toward a user's toe to form a wedge shaped configuration to mate with the inclined foot engaging members.

None of the aforementioned prior art of record addresses the utility of a baseball or softball swing training apparatus that teaches a batter the combination of proper distribution of weight on the rear leg during the swinging motion, raising of the rear heel during the natural pivoting motion of a swing so as to transfer pressure to the ball of the foot, and proper rotation of the hips during the swinging motion, these elements when performed in unison promoting quicker or increased hand speed resulting in an increase of power at the plate.

SUMMARY OF THE INVENTION

The present invention provides a means for urging the rear foot or heel of a user, when placed thereon, in an upward direction during the swinging motion causing the hips of the user to rotate promoting quicker/increased hand speed, the combination thereof resulting in an increase of power at the plate.

The increase of power at the plate can be achieved by use of an apparatus known as the Power Pivot. The Power Pivot is comprised of an upper and lower platform member. In a preferred embodiment, the platform members are essentially identical in dimensions and shape. The platform members have a generally rectangular body with at least one side of each platform member formed as an extending finger portion, projection, protrusion, or similarly shaped element. The extending finger portion of the upper platform member receives thereon a spring loaded foot mechanism. The spring loaded foot mechanism is preferably comprised of a continuous cylindrical member having upper and lower generally U-shaped ends, the upper and lower U-shaped ends being generally orthogonal to one another forming an L-shaped continuous cylindrical member. The upper U-shaped end is preferably shorter than the lower U-shaped end. There is a biased element, such as a coiled spring, which is secured at its ends to the upper platform member and to the upper U-shaped end by means of a hook shaped element. The biased element is preferably secured to the upper platform member by means of an elongated rod, the ends of which are received within apertures defined by the coiled spring. The ends of the rod are in turn received within an eye portion of spaced apart eyebolts. The eye bolts are screwed into the upper surface of the upper platform member, thus securing the biased element and in turn the spring loaded foot mechanism thereto. The biased element is preferably positioned immediately within the area defining the extending finger portion, but can also be positioned on the upper surface of the upper platform member on an end opposite the extending finger portion, i.e., within the rectangular body of the upper platform member. The other end of the biased element may terminate in hook that is securely engaged with an arm of the upper U-shaped end. The continuous cylindrical member is free to rotate about the elongated rod, but is biased and limited in rotational range by the coiled spring member. The biased element/coiled spring member thus provides a means for controlling rotation of the continuous cylindrical member about the elongated rod as the spring loaded foot mechanism/continuous cylindrical member is in loaded and unloaded conditions.

In an unloaded condition, the upper U-shaped end of the spring loaded foot mechanism extends upwardly from and orthogonal to the upper surface of the upper platform member. The lower U-shaped end will lie generally parallel to the upper surface of the upper platform member. In a loaded condition, i.e., when a user's heel or bottom of the foot depresses the upper U-shaped member, the lower U-shaped end will extend upwardly from and orthogonal to the upper surface of the upper platform member in such a manner that the heel of the user's foot is engaged with the lower U-shaped end and the bottom of the user's foot is engaged with the now depressed upper U-shaped member.

The upper and lower platform members are rotatably secured to one another by means of a bearing plate assembly. The bearing plate assembly is comprised of opposed bearing plate assembly members. An upper bearing plate assembly member is secured to a lower surface of the upper platform member by screws, rivets, or other similar securing means. A lower bearing plate assembly member is secured to an upper surface of the lower platform member by screws, rivets, or other similar securing means. The bearing plate assembly members are each formed with circular grooves to form a recess for receiving ball bearings there-between. The bearing plate assembly members may be secured to one another by means of a pivot pin, shaft, or other similar type fastener; though a centrally located pivot pin or shaft is not required. This arrangement allows for 360 degree rotation of the bearing plate assembly members relative to one another. In turn, this allows for 360 degree rotation of the upper and lower platform members when the bearing plate assembly members are secured to their respective platform members.

The platform members are preferably formed of a rigid polymeric composite resinous material similar to those used as an encasement for marine products. This material is light weight, UV resistant, fire retardant, durable, weather resistant, water proof, and is chemical resistant. The platform members can also be made of other rigid materials such as wood, hard plastics, metals, or combinations thereof. The upper surface of the upper platform member and the bottom surface of the lower platform member each have a nonslip or non skid surface. This can be in the form or corrugations, rubber surfaces, or other similar non-slip surface materials adhesively applied to the platform members. The spring loaded foot mechanism is preferably made of rust resistant hard metals, but can be made of any weather resistant material capable of withstanding repetitive loading of a user's foot thereon. The bearing plate assembly is also preferably made of rigid rust resistant materials such as stainless steel, but can be made of any other conventional substantially rigid material. The Power Pivot can be dimensioned to accommodate at a minimum the foot of a professional athlete, which may be as large as a size 22 men's shoe. But ideally, the Power Pivot can be fabricated in a variety of sizes to fit users of all foot sizes, shapes, and genders.

DETAILED DESCRIPTION OF THE PREFERRED EMBODIMENT

Figure 1:
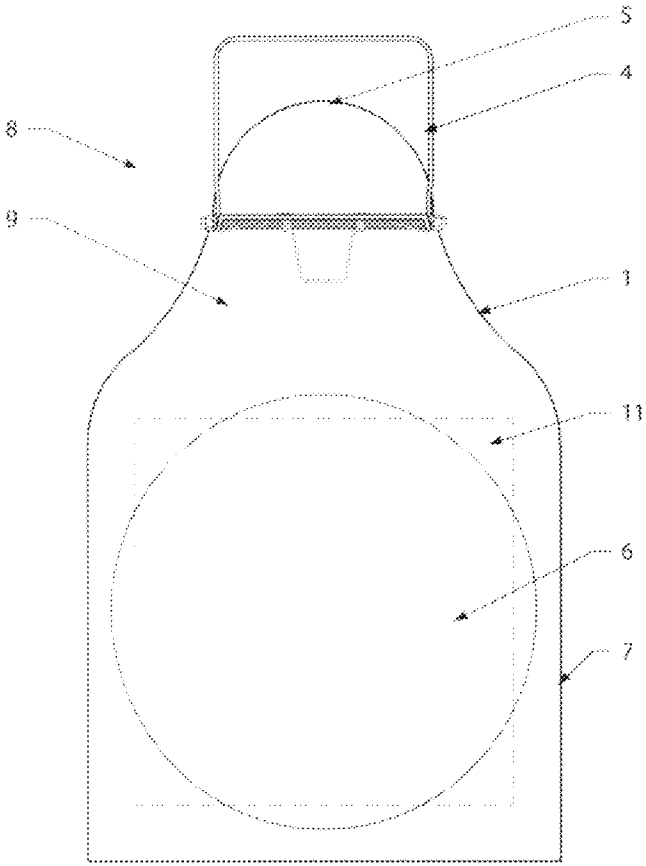
FIG. 1 is a plan view of the Power Pivot showing the upper platform member and associated components.

FIG. 1 is a plan view of the Power Pivot 8. The Power Pivot 8 is comprised of an upper platform member 1 and a lower platform member 2, shown in shadow in FIG. 1. The two platform members are rotatable relative to one another through 360 degrees of rotation and are preferably shaped and sized to similar dimensions. Each platform member 1, 2 of the Power Pivot 8 has a rectangular body 7 that terminates on side in the form of an extending finger portion 5. Affixed to finger portion 5 on an upper surface 9 of upper platform member 1, is a spring loaded foot mechanism 4. The upper surface 9 can also have a non skid surface 6 formed integral to the upper surface 9 or placed thereon by means of adhesives. The platform members are formed of a rigid polymeric composite resinous material similar to those used as an encasement for marine products. This material is light weight, UV resistant, fire retardant, durable, weather resistant, water proof, and is chemical resistant. The platform members can also be made of other rigid materials such as wood, hard plastics, metals, or combinations thereof.

Figure 2:
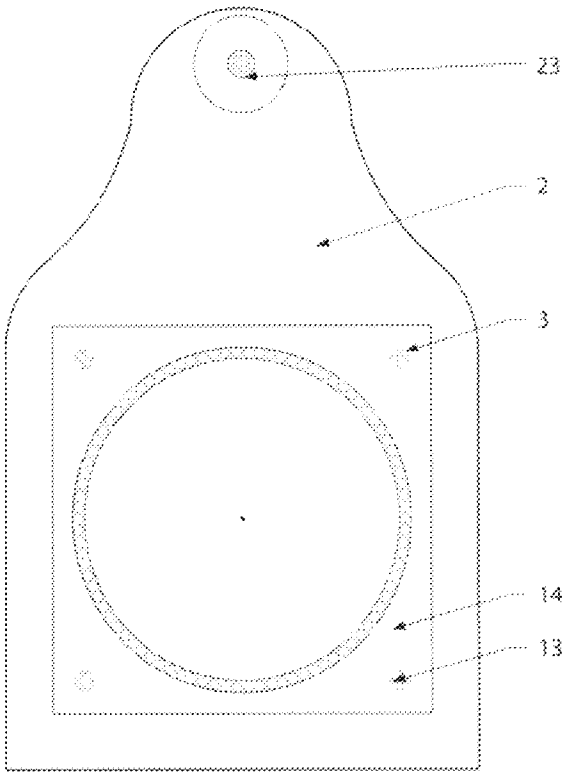
FIG. 2 is a plan view of the Power Pivot minus the upper platform member, showing the bearing assembly and rubber spacer mounted to the upper surface of the lower platform member.

FIG. 2 is a plan view of the Power Pivot 8 sans the upper platform member, showing a bearing assembly 3 and rubber spacer 23 securable to either of the upper platform member or lower platform member and located there between, so as to limit vertical movement between the upper and lower platform members. The structure of bearing assembly 3 will be addressed in the discussion of FIG. 7.

FIGS. 3-6 are a side view of the Power Pivot 8. Spring loaded foot mechanism 4 is located at a forward end of finger portion 5. A bottom surface 10 of lower platform member 2 can be affixed with a nonskid surface 33 or with ground engaging spikes (not shown) that permit the lower platform member 2 to be affixed to a support surface in a use condition.

Figure 5:
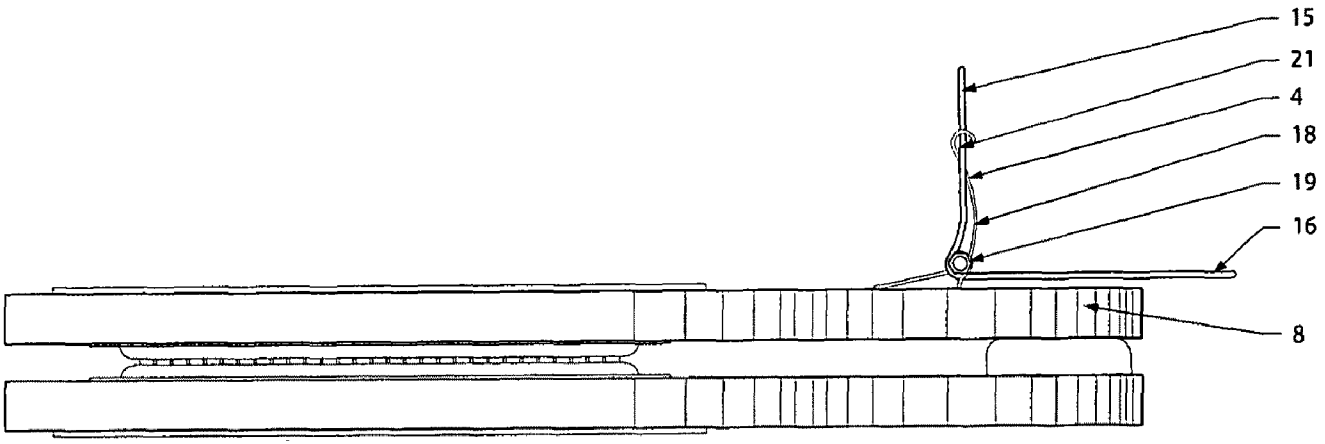
Figure 6:
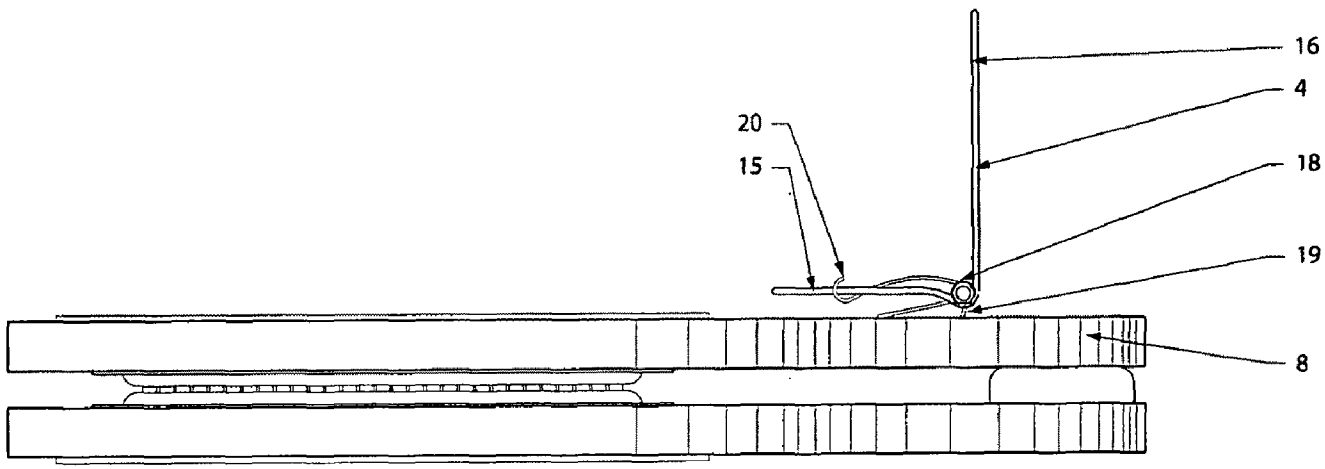

FIGS. 5 and 6 offer a detailed view of the spring loaded foot mechanism. The spring loaded foot mechanism 4 is preferably comprised of a continuous cylindrical member having upper and lower generally U-shaped ends 15, 16, respectively, the upper and lower ends being generally orthogonal to one another forming an L-shaped continuous cylindrical member. The upper U-shaped end 15 is preferably shorter than the lower U-shaped end 16. There is a biased element, such as a coiled spring member 18, which is secured at one end to the upper platform member 1 and to the upper U-shaped end 15 by means of a hook shaped element 20. The biased element is preferably secured to the upper platform member 1 by means of an elongated rod (unnumbered), the ends of which are received within apertures defined by the coiled spring member 18. The ends of the rod are in turn received within an eye portion of spaced apart eyebolts (also unnumbered). The eye bolts are screwed into the upper surface 9 of the upper platform member 1, securing the spring loaded foot mechanism 4 thereto. The biased element is preferably positioned immediately within the area defining the extending finger portion 5, but can also be positioned on the upper surface 9 of the upper platform member 1 on an end opposite the extending finger portion 5. The other end of the biased element may terminate in hook 20 that is securely engaged with an arm 21 of the upper U-shaped end 15. The continuous cylindrical member is free to rotate about the elongated rod, but is biased and limited in rotational range by the coiled spring member 18. The biased element/coiled spring member 18 provides a means for controlling rotation of the continuous cylindrical member about the elongated rod as the continuous cylindrical member is in loaded and unloaded conditions.

Figure 3:
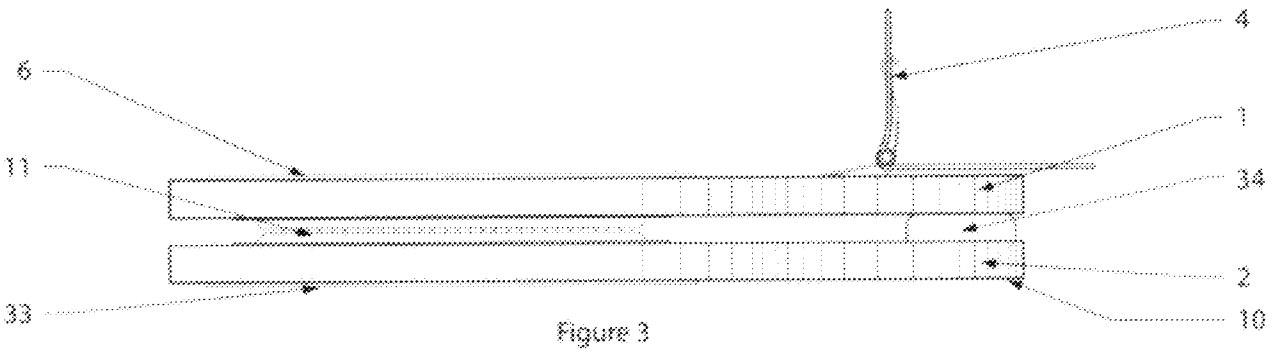
FIGS. 3 and 5 show a side view of the Power Pivot showing spring loaded foot mechanism mounted on the upper surface of the upper platform member in an unloaded condition.
Figure 4:
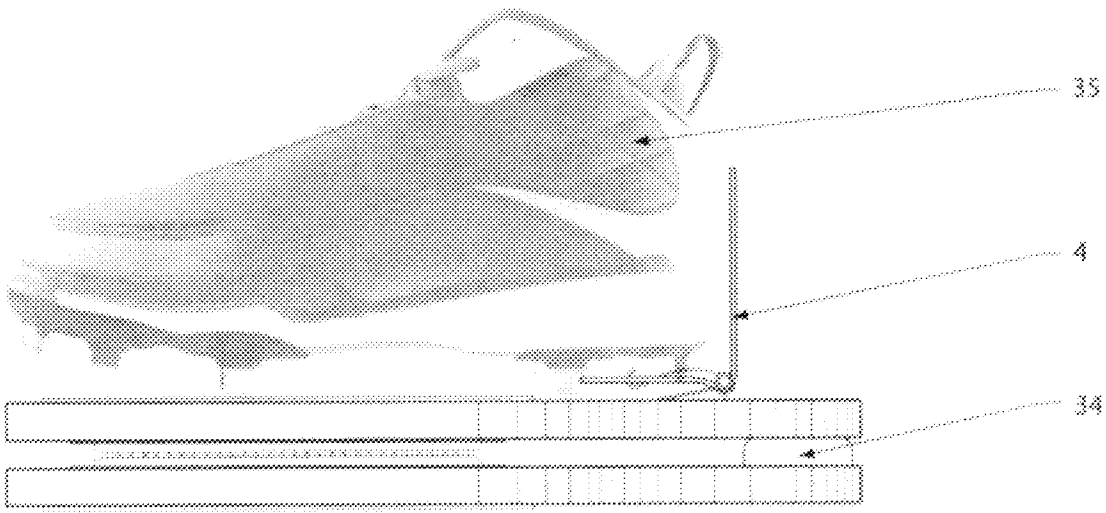
FIGS. 4 and 6 are a side view of the Power Pivot showing the spring loaded foot mechanism in a loaded condition.

In an unloaded condition, as best seen in FIGS. 3 and 5, the upper U-shaped end 15 of the spring loaded foot mechanism 4 extends upwardly from and orthogonal to the upper surface of the upper platform member 1. The lower U-shaped end 16 will lie generally parallel to the upper surface of the upper platform member. In a loaded condition, as best seen in FIGS. 4 and 6, i.e., when a user's heel or bottom of the foot depresses the upper U-shaped member, the lower U-shaped end will extend upwardly from and orthogonal to the upper surface of the upper platform member in such a manner that the heel of the user's foot or shoe 35 is engaged with the lower U-shaped end 16 and the bottom of the user's foot or shoe 35 is engaged with the now depressed upper U-shaped member 15.

Figure 7:
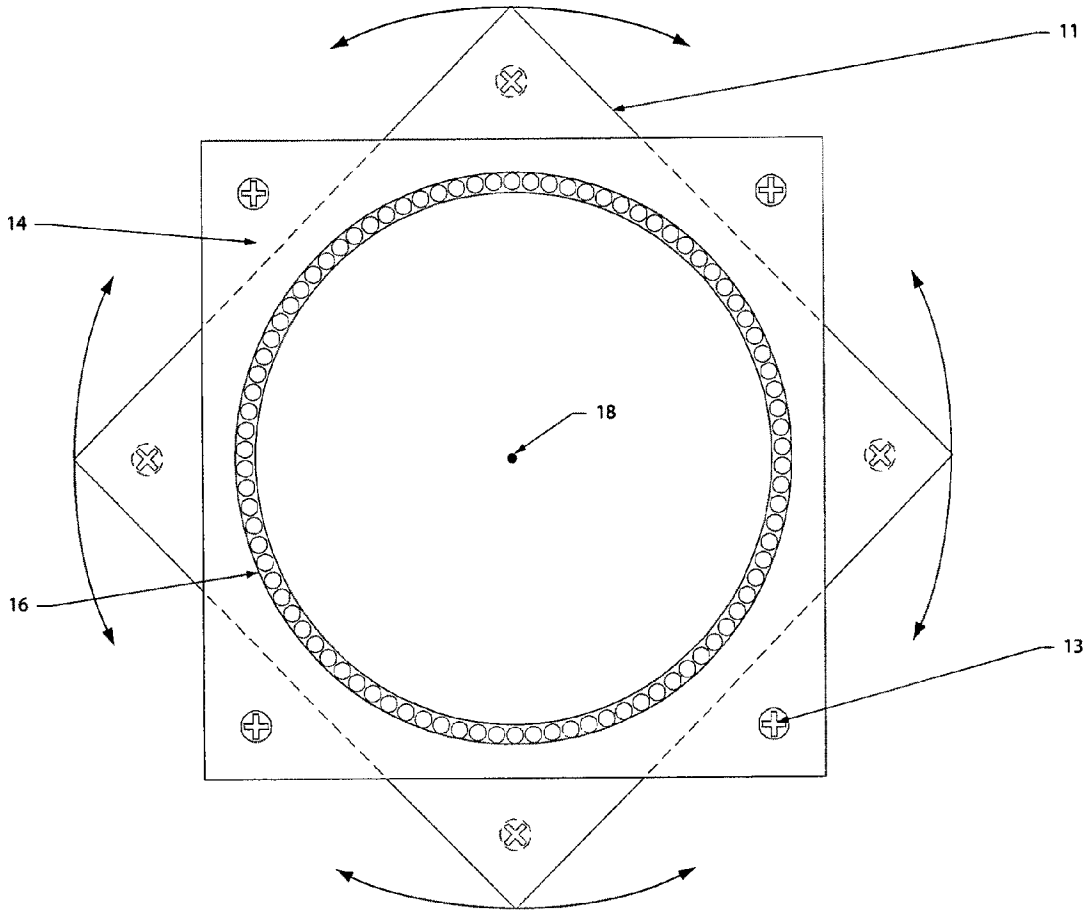
FIG. 7 shows the components of the bearing plate assembly.

FIG. 7 shows the components of bearing plate assembly 3. The bearing plate assembly is comprised of opposed bearing plate assembly members. An upper bearing plate assembly member 11 is secured to a lower surface 12 of the upper platform member 1 by fastening members 13, or other similar securing means. A lower bearing plate assembly member 14 is secured to an upper surface 15 of the lower platform member 2 by fastening members 13 or other similar securing means. The bearing plate assembly members are each formed with circular grooves 16 to form a recess for receiving ball bearings 17 there-between. The bearing plate assembly members can be secured to one another by means of a pivot pin 18, though it is not required. This arrangement allows for 360 degree rotation of the bearing plate assembly members relative to one another. In turn, this allows for 360 degree rotation of the upper and lower platform members 1, 2 when the bearing plate assembly members are secured to their respective platform members.

Figure 8:
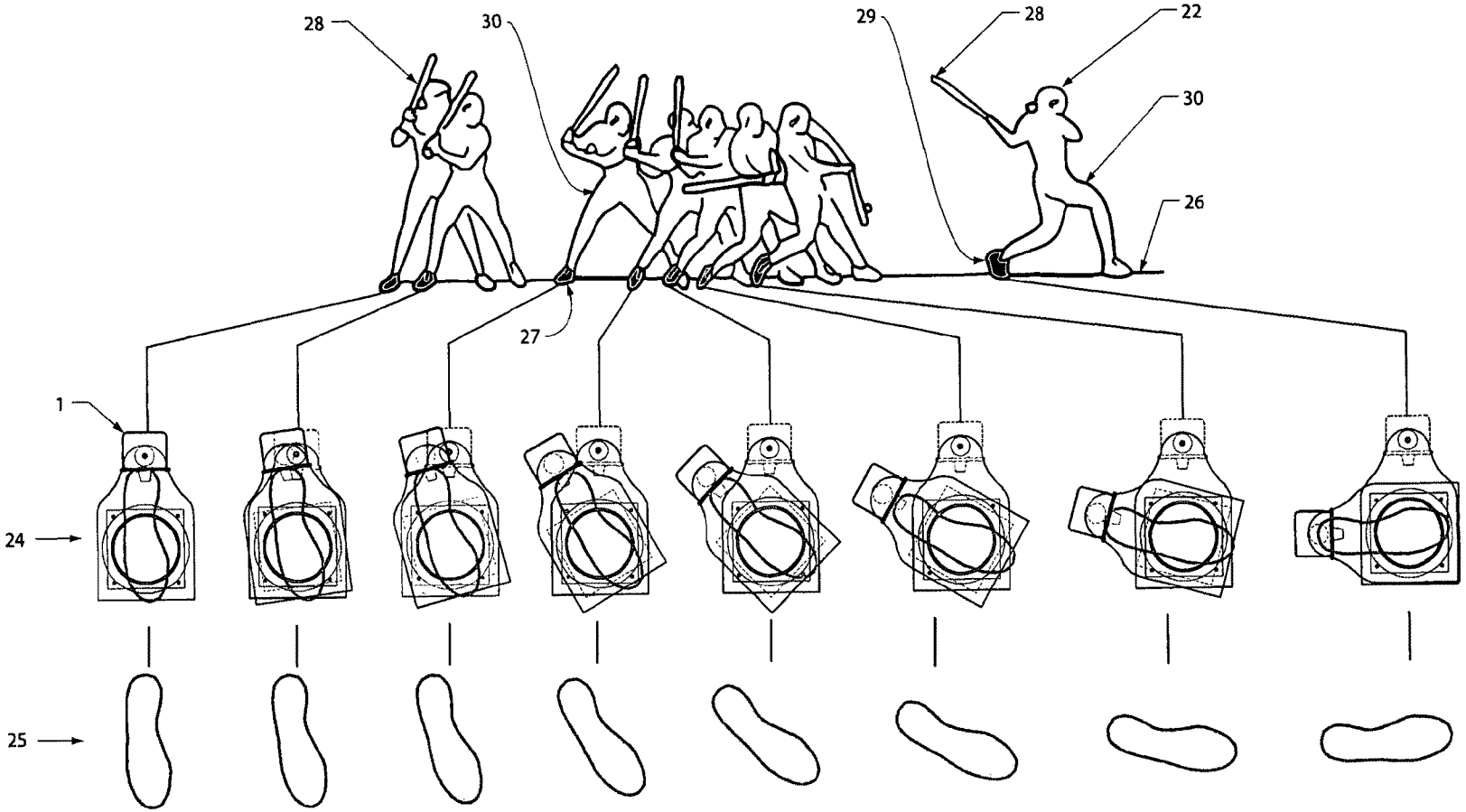
FIG. 8 shows the Power Pivot in use.

In use, as best seen in FIG. 8, the Power Pivot 8 is placed upon a flat level surface 26 that provides a firm standing support surface. The side with the spring loaded foot mechanism 4 is placed up. The heel 27 of the user's rear foot is placed upon the spring loaded foot mechanism 4 with the front portion of the rear foot extending onto the rectangular body 7 of the upper platform member 1, shown as swivel position 24. As the spring loaded foot mechanism 4 is loaded (depressed) with the weight of the user's heel 27, the hitter or batter 22 goes through a conventional batting motion. As the upper platform member 1 rotates as a result of the natural swinging motion 28, the now loaded spring loaded foot mechanism 4 urges the heel 27 of the user in an upward direction, the position of the user's foot 25 shown in FIG. 8. A right handed batter for example would place his or her right foot on the upper platform member 1 and a left handed batter conversely, would place their left foot on the upper platform member. As the heel of a user's foot is biased upward, the user's weight or rather the pressure exerted upon the heel 27 of the rear foot is transferred to the ball 29 of the user's foot, forcing the hips 30 of the user to rotate. The rotation of the hips 30 allows a user to generate quicker hand or bat speed. The result of the aforementioned steps when performed in an ideal manner is increased batting power for the hitter. The Power Pivot 8 when used properly is an ideal teaching aid for fundamental batting mechanics of a hitter.

Figure 9:
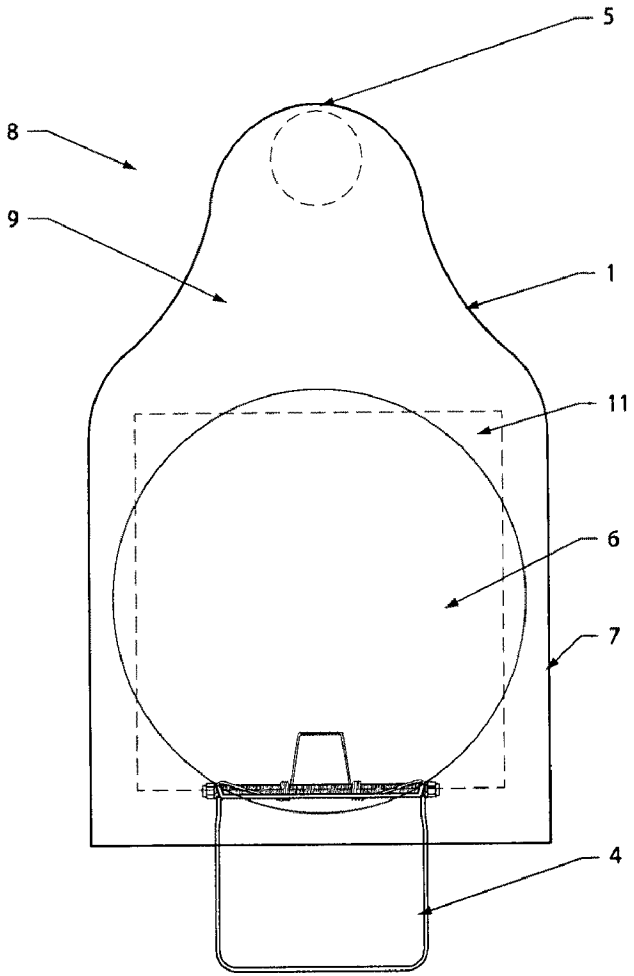
FIG. 9 is an alternative embodiment of the instant invention with the spring loaded foot mechanism positioned within the rectangular body of the upper platform member.

FIG. 9 shows an alternative embodiment of the instant invention wherein the spring loaded foot mechanism 4 is positioned within the rectangular body 7 of the upper platform member 1. In this embodiment, the Power Pivot 8 is used in the same manner as described above. The spring loaded foot mechanism is preferably affixed near an outer edge of the rectangular body 7, opposite of the extending finger portion 5. However, the actual positioning will vary for the desired use and size of a user's foot.

The Power Pivot can be formed of a rigid polymeric composite resinous material similar to those used as an encasement for marine products. This material is light weight, UV resistant; fire retardant, durable, weather resistant, water proof, and is chemical resistant. The platform members can also be made of other rigid materials such as wood, hard plastics, metals, or combinations thereof. The bearing plate assembly is also preferably made of rigid rust resistant materials such as stainless steel, but can be made of any other conventional substantially rigid material.

The Power Pivot offers a low cost, low maintenance swing training apparatus that teaches a batter the combination of proper distribution of weight on the rear leg during the swinging motion, raising of the rear heel during the natural pivoting motion of a swing so as to transfer pressure to the ball of the foot, and proper rotation of the hips during the swinging motion, these elements when performed in unison promoting quicker or increased hand speed resulting in an increase of power at the plate.

The above embodiments of the instant invention have been presented so as to not limit the invention to only those embodiments. It is contemplated that obvious variations, modifications, and improvements are within the skill of one familiar to relevant arts.

What is claimed is:

1. A baseball swing training device comprising:

an upper platform member and a lower platform member that are rotatably secured to one another by a bearing plate assembly;

the platform members each having a generally rectangular body with at least one side of each platform member formed as an extending finger portion, an upper surface of the upper platform member having a spring loaded foot mechanism fixedly secured thereon;

the spring loaded foot mechanism comprising a continuous cylindrical member having upper and lower generally U-shaped ends, the upper and lower U-shaped ends being generally orthogonal to one another forming an L-shaped continuous cylindrical member and the upper U-shaped end being shorter than the lower U-shaped end;

the spring loaded foot mechanism further comprising a biased element assembly which is securable to the upper platform member and to the upper U-shaped end, the biased element assembly further comprising a hook shaped element and an elongated rod, the hook shaped element being securable to an arm of the upper U-shaped end, the biased element assembly being securable to the elongated rod, the elongated rod having ends which are received within an eye portion of respective spaced apart eyebolts, the eye bolts being securable to the upper surface of the upper platform member, thus securing the spring loaded foot mechanism to the upper platform member; and wherein in an unloaded condition, the upper U-shaped end of the spring loaded foot mechanism extends upwardly from and orthogonal to the upper surface of the upper platform member and the lower U-shaped end will lie generally parallel to the upper surface of the upper platform member; and wherein a loaded condition, the lower U-shaped end extends upwardly from and orthogonal to the upper surface of the upper platform member in a manner that the heel of the user's foot is engaged with the lower U-shaped end and a bottom of the user's foot is engaged with the now depressed upper U-shaped end.

2. The device of claim 1, wherein the bearing plate assembly is comprised of upper and lower bearing plate assembly members rotatably secured to one another, the upper bearing plate assembly member securable to a lower surface of the upper platform member by a fastening member, the lower bearing plate assembly member is securable to an upper surface of the lower platform member by fastening members, each bearing plate assembly member formed with circular grooves to form a recess for receiving ball bearings there-between.

3. The device of claim 1, wherein the biased element assembly is a coiled spring member.

4. The device of claim 1, wherein the spring loaded foot mechanism is positioned within the extending finger portion of the upper platform member.

5. The device of claim 1, wherein the spring loaded foot mechanism is positioned within the rectangular body of the upper platform member.

6. The device of claim 1, wherein the upper and lower platform members are made of a rigid polymeric composite resinous material.

7. The device of claim 2, wherein the bearing plate assembly is made of a rigid rust resistant material.

8. The device of claim 1, wherein a bottom surface of the lower platform member is affixed with a nonskid surface that enables the lower platform member to be affixed to a support surface in a use condition.

9. The device of claim 8, wherein the non skid surface is formed of ground engaging spikes.

10. The device of claim 1, wherein the upper surface of the upper platform member is affixed with a nonskid surface.

11. The device of claim 1, wherein a rubber spacer is affixed to the extending portion of the lower platform member on an upper surface thereof, so as to limit vertical movement between the upper and lower platform members.

12. A baseball swing training device comprising:

an upper platform member and a lower platform member that are rotatably secured to one another by a bearing plate assembly;

the platform members each having a generally rectangular body with at least one side of each platform member formed as an extending finger portion, an upper surface of the upper platform member having a spring loaded foot mechanism fixedly secured thereon;

the spring loaded foot mechanism comprising a continuous cylindrical member having upper and lower generally U-shaped ends, the upper and lower U-shaped ends being generally orthogonal to one another forming an L-shaped continuous cylindrical member and the upper U-shaped end being shorter than the lower U-shaped end;

the spring loaded foot mechanism further comprising a biased element assembly which is securable to the upper platform member and to the upper U-shaped end, the biased element assembly further comprising a hook shaped element and an elongated rod, the hook shaped element being securable to an arm of the upper U-shaped end, the biased element assembly being securable to the elongated rod, the elongated rod having ends which are received within an eye portion of respective spaced apart eyebolts, the eye bolts being securable to the upper surface of the upper platform member, thus securing the biased element assembly and in turn the spring loaded foot mechanism to the upper platform member; and the biased element assembly providing a means for controlling rotation of the continuous cylindrical member about the elongated rod as the continuous cylindrical member is in loaded and unloaded conditions.

13. The device of claim 12, wherein in the unloaded condition, the upper U-shaped end of the spring loaded foot mechanism extends upwardly from and orthogonal to the upper surface of the upper platform member and the lower U-shaped end will lie generally parallel to the upper surface of the upper platform member; and wherein in the loaded condition, the lower U-shaped end extends upwardly from and orthogonal to the upper surface of the upper platform member in a manner that the heel of the user's foot is engaged with the lower U-shaped end and a bottom of the user's foot is engaged with the now depressed upper U-shaped end.

14. The device of claim 12, wherein the bearing plate assembly is comprised of an upper and lower bearing plate assembly members rotatably secured to one another, the upper bearing plate assembly member securable to a lower surface of the upper platform member by a fastening member, the lower bearing plate assembly member is securable to an upper surface of the lower platform member by fastening members, each bearing plate assembly member formed with circular grooves to form a recess for receiving ball bearings there-between.

15. The device of claim 12, wherein the biased element assembly is a coiled spring member.

16. The device of claim 12, wherein the spring loaded foot mechanism is positioned within the extending finger portion of the upper platform member.

17. The device of claim 12, wherein the spring loaded foot mechanism is positioned within the rectangular body of the upper platform member.

18. The device of claim 14, wherein the bearing plate assembly is made of a rigid rust resistant material the upper and lower platform members are made of a rigid polymeric composite resinous material.

19. The device of claim 12, wherein a rubber spacer is affixed to the extending portion of the lower platform member on an upper surface thereof, so as to limit vertical movement between the upper and lower platform members.

20. The device of claim 12, wherein the upper surface of the upper platform member is affixed with a nonskid surface and a bottom surface of the lower platform member is affixed with a nonskid surface that enables the lower platform member to be affixed to a support surface in a use condition.

* * * * *